US006613271B1

(12) United States Patent
Lewis-Gray

(10) Patent No.: US 6,613,271 B1
(45) Date of Patent: Sep. 2, 2003

(54) APPARATUS AND METHODS FOR RECOVERING VALUABLE METALS

(76) Inventor: Alexander Hamilton Lewis-Gray, 321 Learmonth Road, Ballarat, Victoria, 3350 (AU)

( * ) Notice: Subject to any disclaimer, the term of this patent is extended or adjusted under 35 U.S.C. 154(b) by 0 days.

(21) Appl. No.: 09/646,021

(22) PCT Filed: Mar. 1, 1999

(86) PCT No.: PCT/AU99/00114

§ 371 (c)(1),
(2), (4) Date: Sep. 12, 2000

(87) PCT Pub. No.: WO99/47714

PCT Pub. Date: Sep. 23, 1999

(30) Foreign Application Priority Data

Mar. 13, 1998 (AU) ..... PP 2304

(51) Int. Cl.[7] ..... C22B 13/08
(52) U.S. Cl. ..... 266/101; 266/170
(58) Field of Search ..... 266/101, 170; 204/66; 423/94, 98

(56) References Cited

U.S. PATENT DOCUMENTS 1,066,880 A * 7/1913 Bradley ..... 266/101
2,907,561 A * 10/1959 Newsom ..... 266/101
3,392,003 A * 7/1968 Partridge et al. ..... 266/101
3,400,871 A * 9/1968 Davis ..... 266/101
3,730,689 A * 5/1973 Odom et al. ..... 23/269
4,082,629 A 4/1978 Milner et al.
4,571,263 A 2/1986 Weir et al.
4,571,264 A 2/1986 Weir et al.

FOREIGN PATENT DOCUMENTS

CA 1 160 055 1/1984
CA 12 21 842 5/1987

OTHER PUBLICATIONS

The Sir Maurice Mawby, Memorial vol., *Australasian Mining and Metallurgy, 2d Ed.*, vol. 214, 1993, pp. 921–1031.
Arthur F. Taggart, *Handbook Of Mineral Dressing, Ores And Industrial Minerals*,1954, pp. 2–96–2–129.

* cited by examiner

*Primary Examiner*—Scott Kastler
(74) *Attorney, Agent, or Firm*—Allen, Dyer, Doppelt, Milbrath & Gilchrist, P.A.

(57) ABSTRACT

Apparatus and method for continuously separating a dense valuable material such as gold from a feed including a grinding mill (2) which directs a crushed feed through hydrocyclones (9) for separation into a light and dense fraction. The dense fraction is concentrated further by in Line Pressure Jigs (16,17) in line and the concentrate (23) is leached in a rotating leaching reactor (45). The resulting pregnant liquor is subjected to electrowinning (83) to recover gold and the spent liquor is recycled.

12 Claims, 2 Drawing Sheets

APPARATUS AND METHODS FOR RECOVERING VALUABLE METALS

FIELD OF THE INVENTION

This invention relates to apparatus and methods for recovering valuable metals. particularly gold using an in line leach reactor. In particular non-limiting aspects, the invention also provides apparatus for dewatering and leach reactors which may be suitable for carrying out the method the invention.

BACKGROUND OF THE INVENTION

Processes for the recovery of gold from gold bearing feeds have typically involved the use of a cyanidation step to convert the elemental gold into a soluble ionic form. The gold in solution can then be separated from the bulk mineral material which stays in solid form by a simple liquids/solids separation process (e.g. sedimentation or filtration).

The solution containing dissolved gold is then subjected to a gold recovery process such as the carbon-in-pulp process. In this process the gold in solution is adsorbed on an activated carbon substrate in the form of carbon granules and the gold is subsequently recovered.

While such processes have been successful in retrieving a significant proportion of the gold embedded in certain minerals, they suffer from significant disadvantages. For example, if the gold is present as nuggets or flakes larger than microscopic pieces, the cyanidation process, because of the relatively low concentration of the reagents used in the process, will generally not succeed in dissolving the larger pieces of gold. As a result. these larger pieces may be lost with the waste minerals discarded following the cyanidation process.

Furthermore, it is often the case that the minerals associated with gold deposits also include a proportion of native carbon. Unfortunately, this carbon is generally in a form which cannot be readily recovered or separated from the minerals. During the cyanidation process, the native carbon can adsorb a proportion of the gold during the leaching process. Depending upon the level of native carbon present in the mineral, the time taken for the leaching process and the concentration of the leaching reagents (i.e. sodium or potassium hydroxide and sodium or potassium cyanide) the amount of gold lost in this way can be quite significant.

Given the large volumes of mineral material which need to be treated using the cyanidation process, it is not practical to use high concentrations of reagents because of their cost, and also because of the environmental concerns associated with the use of large quantities of dangerous reagents. Thus, one is often faced with a situation where the relatively low concentrations of the reagents require high residence times for leaching. The longer the residence time the greater the proportion of gold which will be adsorbed by the native carbon. Thus the presence of native carbon in the minerals being leached means that a significant proportion, perhaps 25% or even 50% or higher of the gold which goes into solution as a result of the leaching reaction can be adsorbed by the carbon in the mineral and is ultimately lost when the leached mineral solids are discarded.

It is possible to ameliorate this problem to some extent by burning off the carbon in a roasting operation prior to leaching. However, it has been found that roasting, whilst it can drive off a significant proportion of the carbon in the mineral as carbon dioxide, is not totally effective in that a substantial quantity of the carbon can still survive the roasting process and remain in solid form intimately admixed or bound with the mineral. Thus, even after roasting, a significant proportion of the gold may be adsorbed by the remaining native carbon in the mineral during leaching. Furthermore, because the process of roasting is very energy intensive, the economics of the gold recovery process can be significantly worsened. This is particularly in light of the fact that gold deposits generally include only extremely small quantities of gold (of the order of grams per tonne) with the result that a huge amount of energy needs to be expended to roast tonnes of ore only to yield grams of gold.

Thus there is a need for a process and apparatus which avoids the need for a roasting step but which can yield high gold recovery rates not withstanding the fact that the minerals with which the gold is associated may include significant amounts of native carbon and/or pieces of gold of a size which are larger than a microscopic size i.e. large enough to be captured by a screen of 500 microns or even 1000 microns.

It is also desirable that the process and/or apparatus have a broad range of applications such as the recovery of gold from sulphide bearing minerals and concentrates or any other minerals which do not give high recoveries with normal gravity processes. It is even more desirable that the process and apparatus be adaptable to recover other valuable materials such as copper.

SUMMARY OF THE INVENTION

The invention provides, apparatus for the separation of a dense valuable material from a feed, including:

- concentrator means for forming a concentrator containing the dense valuable material from the feed,
- a leach reactor which includes a hollow member with inlet means and outlet means,
- supply means for continuously supplying an aqueous leach reagent and the concentrate to the inlet means,
- drive means for rotating the hollow member,
- flow control means in the hollow member for controlling the rate of flow of the mixture of aqueous leach reagent and concentrate through the hollow member from the inlet means to the outlet means;
- a solids/liquids separator for separating pregnant liquor from solids arranged to receive the mixture from the outlet means,
- a recovery station for recovering dense valuable material from solution in the pregnant liquor to leave a spent leachate, and
- recycle means for recycling the spent leachate to the leach reactor.

The term concentrator includes any form of apparatus for concentrating dense material in a feed or for separating dense material from a feed. Thus it includes conventional jigs or separators such as the "Harz Jig", "Hancock Jig" or a separator of the type described and claimed in Australian Patent No. 684153 hereinafter referred to as the "In Line Pressure Jig". It also includes banks of two or more concentrators joined in parallel or series.

An In Line Pressure Jig is a pressurised concentrator which uses an agitated bed to separate dense particulates from a slurry. The slurry flows across the top of the bed with dense particulates from the slurry passing through the bed to be collected in a hutch. The less dense tailings pass over the outer edge of the bed to be discharged via a tailings outlet.

The apparatus may be associated with a conventional gold recovery circuit such as a cyanidation circuit.

Suitably, the apparatus includes at least one concentrator which is an In Line Pressure Jig. The apparatus may include more than one concentrator. Where there is more than one concentrator the concentrators may be in series or in parallel. Most preferably they are in series.

In a preferred form of the invention the apparatus includes two In Line Pressure Jigs in series.

The or each concentrator may include an inlet, an overflow and an outlet. Thus the inlet may be arranged to receive incoming material containing the feed. The incoming material is most suitably mixed with water. The outlet may constitute an outlet for material which has been concentrated by the concentrator. The overflow may be arranged to allow material rejected by the concentrator to flow out of the concentrator.

Means for crushing a feed, such as a gold bearing feed, may be provided in association with the apparatus. The means for crushing may include a grinding mill.

Primary separator means may he associated with the apparatus. The primary separator means may be arranged to receive crushed feed from the means for crushing and to redirect it into a light fines stream, a heavy fines stream and a coarse material stream. Suitably the primary separator means is arranged to redirect the coarse material stream into the means for crushing.

The light fines stream may be directed to a gold removal circuit.

The heavy fines stream may be directed to the or each concentrator.

Suitably the primary separator means includes a cyclone. It may include a plurality of cyclones. Most suitably the cyclones are hydrocyclones.

The heavy fines stream from the primary separator means may be directed to a first concentrator via the inlet thereof. Suitably the overflow of the concentrator may be arranged to direct rejected material from the concentrator to the coarse material stream emanating from the primary separator means.

The outlet of the first concentrator may be directed to the inlet of a second concentrator.

Suitably the concentrate emanating from the outlet of the second concentrator is directed to the leach reactor.

In a particularly preferred form of the invention a dewatering station may be provided to dewater concentrate prior to being fed to the leach reactor. The dewatering station may include a container having a conical base, a valve for metering the overflow of dewatered solids material from an outlet at the bottom of said base and weighing means for measuring the weight of material in said dewatering station, said valve being responsive to measurements of said weighing means to control the rate of outflow of dewatered solids from the outlet of said dewatering station. Thus, in a further aspect the invention provides a dewatering station along the lines of that described herein above.

Suitably the leach reactor is arranged to receive concentrate continuously or intermittently for continuous or intermittent leaching of the concentrate. Most suitably the reactor is in the form of a cylinder closed off at each end. It may include drive means for rotating the reactor. It may include flow control means for controlling flow through the leach reactor. Most preferably it includes a plurality of baffles for controlling the flew of leach material through the leach reactor. Most suitably there are two baffles. The baffles may separate the reactor into three or more zones. One or more openings will be provided in each of the baffles to allow communication between the zones. The openings are most suitably provided in proximity to the wall of the leach reactor to control the flow of leach material therethrough as the reactor rotates. Openings on adjacent baffles are most suitably provided on diametrically opposites sides of the cylinder.

An inlet may be provided at one end of the leach reactor and an outlet at the other end. Most suitably the inlet is provided in line with the axis of the cylinder. Similarly the outlet may be provided at the other end in line with the axis of the cylinder. Most suitably, the inlet is of smaller size than the outlet in order to provide a gradient down which the leach material travels as it moves through the leach reactor.

A second dewatering station may be provided to receive leach material from the leach reactor. It suitably includes an inclined linear action dewatering screen. The second dewatering station may be arranged to provide a solids stream and a pregnant liquor stream. The solids stream may be recycled to the first concentrator. The overflow from a second concentrator may also be recycled to the first concentrator via the inlet.

The pregnant liquor stream may be directed to a gold recovery facility. The gold recovery facility may include an electrowinning station. It may also include a settling tank for settling of any solids in the pregnant liquor prior to electrowinning.

Recycling means may be provided to recycle spent liquor from the electrowinning facility to the settling storage tank. The recycling means may also be arranged from the overflow liquid from the settling storage tank to the inlet of the first concentrator.

In a further aspect the invention provides a method for the separation of gold from a feed including the steps of:

(i) crushing the feed;

(ii) concentrating a mixture of the crushed feed and water to form a concentrate stream containing gold wherein at least 80% of the particles in the concentrate stream have a particle size less than 2,000 microns;

(iii) dewatering the concentrate stream;

(vi) leaching the dewatered concentrate stream continuously in a rotating leach reactor with aqueous reagent to form a pregnant liquor;

(vii) controlling the residence time of the dewatered concentrate in the reactor by controlling the rate of rotation of the leach reactor, and (viii) recovering gold from the pregnant liquor.

The leachant liquid may be a mixture of a sodium or potassium hydroxide and sodium or potassium cyanide. The concentration of the cyanide is preferably at least 0.5% by weight of cyanide in the leachant/solid mix. Most suitably the cyanide concentration is at least 1.5%.

Preferably the rotation rate of the leach reactor is such as to produce a peripheral speed of rotation of at least 3 metres per minute, more preferably at least 8 metres per minute. The residence time of the leach material in the reactor is preferably less than 10 hours, most preferably less than two hours.

Oxygen may be introduced into the leachant mixture in the leach reactor to facilitate leaching. The oxygen may be obtained from an electrowinning facility for recovering gold from the leachant liquid. Most suitably the oxygen is added by recycled spent leachant liquid after electrowinning to the leach reactor. Oxygen may also be added through bubbling air and/or oxygen into the leach mix.

The leach reaction my be carried out at relatively low temperatures i.e. below 50° C., more preferably below 40° C. and most preferably at ambient temperature.

Most suitably at least 80% of the concentrate fed to the reactor will have a particle size less than 2000 microns, more preferably less than 1000 microns.

Most suitably the residence time for leaching is adjusted so that at least 70% of gold, more preferably 85% and most preferably at least 90% or even 95% is taken into solution.

Preferably gold recovery from the leachant is by way of electrowinning, or by carbon adsorption or by zinc precipitation processes.

The invention is particularly suitable for recovering gold sulphide and free gold from sulphide and free gold concentrates especially when the gold containing materials will not give high recoveries using normal gravity based processes. Where sulphide bearing concentrates are involved high recoveries may not be readily achievable using low level cyanide leaching conditions. However, more intense conditions such as higher temperatures and/or more concentrated leachant liquid and/or higher leach residence times can increase overall recovery particularly in instances where particles of valuable minerals or metals are partially locked in to other less valuable particles.

Whilst a major application of the invention is the recovery of gold is to be understood that the invention is also applicable to other valuable minerals, such as copper bearing minerals.

The invention will now be described with reference to the accompanying drawings.

DETAILED DESCRIPTION OF THE PREFERRED EMBODIMENTS

Figure 1:
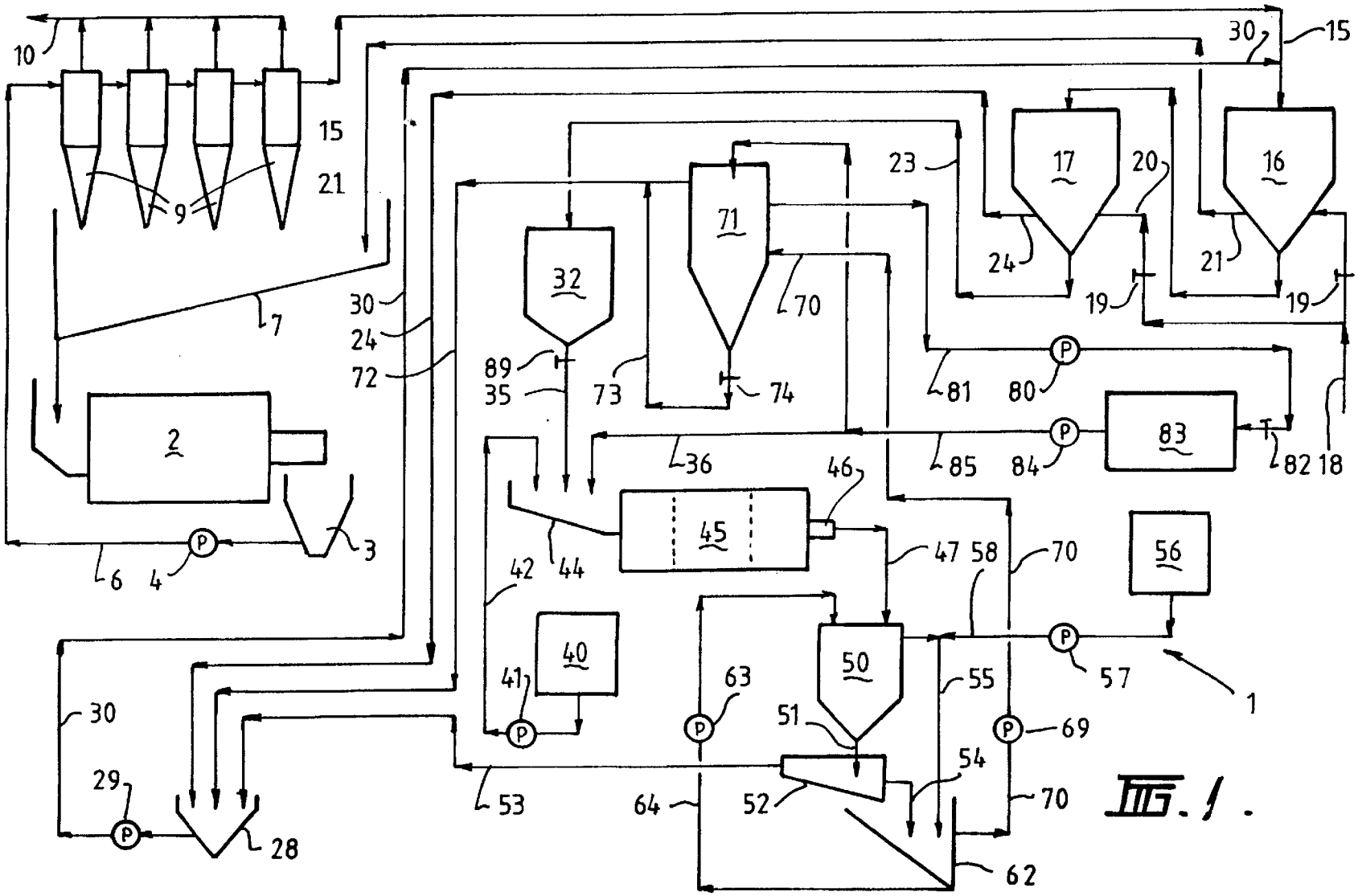
FIG. 1 shows a flow chart for carrying out the process of the invention.

Referring to FIG. 1, the leach circuit for gold containing ores generally designated 1 includes a grinding mill 2 arranged to receive and crush ore and to dump it in the hopper 3.

A pump 4 connected to the hopper 3 serves to pump the slurry in hopper 3 via the pipe 6 to a series of hydrocyclones 9. These hydrocyclones are arranged to discharge coarse and large heavy material into the holding bin which is itself arranged to recycle this material to the grinding mill 2.

The hydrocyclones are provided with two outlets connecting with a pipe 10 and a bleedline 15. The pipe 10 directs light and fine material from the circuit into a conventional gold recovery process and the bleedline 15 takes a denser fraction from the hydrocyclone circuit to form an inlet for a concentration stage.

The concentration stage includes a first and a second concentrator 16 and 17 connected in series. The first and second concentrators are in-line pressure jigs. They are constructed substantially along the lines of the concentrator shown in the drawings of U.S. Pat. No. 6,079,567 and the disclosures in that patent are by this cross reference incorporated herein. The second concentrator is arranged to direct concentrate and rejected material to the dewatering station 32 and overflow tank 28 via the lines 23 and 24 respectively.

Figure 2:
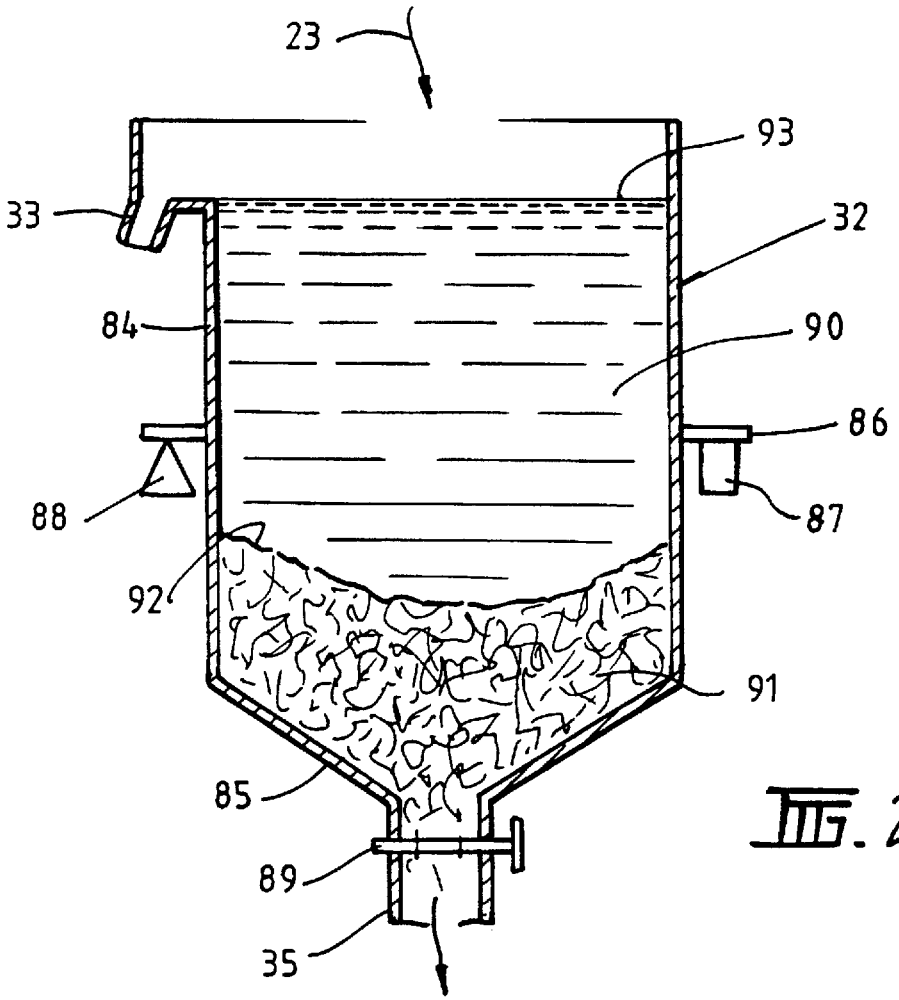
FIG. 2 is a sectional elevational view of a dewatering device in accordance with one aspect of the invention.

The dewatering station 32 is shown in more detail in FIG. 2.

Referring to FIG. 2, the dewatering station includes a cylinder 84 having a conical base 85, and an outlet for dewatered concentrate 35.

A circumferential mounting flange 86 is provided on the cylinder 84 and is mounted on a support 87 and load cell 88.

The valve 89 is controlled by signals from the load cell 88. It is arranged to control the discharge of the solid dewatered material 91 when it has reached the level 92 shown at the side of the cylinder 84. The liquid 90 in the cylinder extends to the level 93 where it overflows into the excess liquid line 33.

Referring to FIG. 1, the dewatered solid 35 from the dewatering station is taken up in the inlet 44 to the leach reactor 45.

Figure 3:
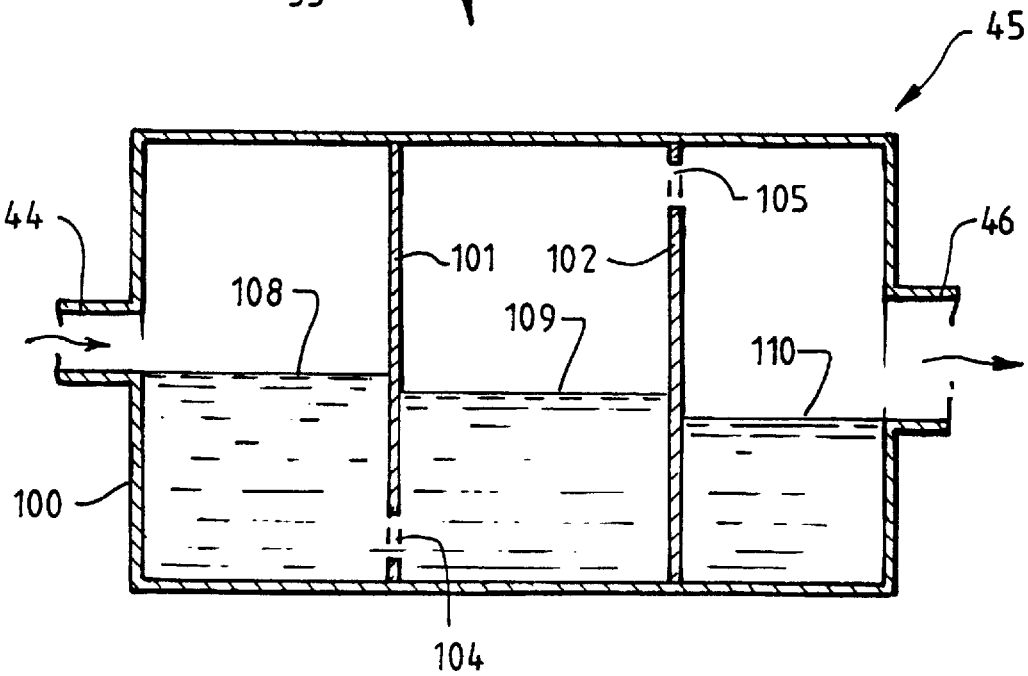
FIG. 3 is a sectional elevational view of a leach reactor in accordance with a further aspect of the invention.

The leach reactor is shown in more detail in FIG. 3.

It includes a rotating drum 100 provided with an inlet 44 and an outlet 46 arranged at each end of the drum in the region of the drum axis.

Baffles 101 and 102 are provided in the drum to control the flow of leach liquid/solid in association with the openings 104 and 105 provided in the baffles.

The openings 104 and 105 are provided near the cylindrical walls of the drum and on opposite sides thereof in order to limit the rate of flow of the leach slurry through the drum. The leach slurry level 108, 109 and 110 in the different parts of the drum forms a gradient across the drum as the outlet 46 is of greater diameter than the inlet 44.

Referring to FIG. 1, a dewatering station 50 is arranged to receive the outflow from the leach reactor and to split it into a dewatered solid stream 51 and a pregnant liquid stream 55.

The dewatered solid stream 51 is directed to a solids separation station 52.

The solid separation station includes a vibrating screen which is slightly inclined to the horizontal, the screen having a mesh size of about 300 microns. Excess liquid 54 is directed to the flocculation tank 62 and the solids recycling line 53 is arranged to direct solids which are balled and separated from the screen into the overflow tank 28.

The pregnant liquor recirculation pump 69 is arranged to direct the pregnant liquor to the settling storage tank 71 from which the pregnant liquor is pumped via the pump 80 to the electrowin station 83. A tap 82 controls the flow of pregnant liquor to the electrowin station.

The electrowin recirculation pump 84 is arranged to pump spent liquor from the electrowin station to the leach reactor inlet 44.

A reagent supply station 40 is provided for the supply of fresh reagents such as caustic soda and sodium cyanide via the dosing pump and the feed line 42 to the inlet 44 of the leach reactor.

Similarly a flocculant supply station 56 is arranged to deliver flocculent via the dosing pump 57 and flocculant delivery line 58 to the flocculation tank 62.

A return pump 29 is arranged to return material from the overflow tank 28 via the return line 30 to the inlet of the concentrator 16.

The settling storage tank has an overflow line 72 which also connects with the overflow tank 28.

The bottom of the settling storage tank 71 is also provided with a solid liquid line 73 and tap 74 for directing settled solids back into the overflow tank 28 as well.

During operation of the apparatus described with reference to FIGS. 1 to 3, the raw ore is directed to the grinding mill 2 where it is crushed and mixed with water to form a slurry. Following comminution it is dumped in the hopper 3.

The pump 4 pumps the resultant slurry via the pipe 6 to the hydrocyclones 9 which separate the slurry into three streams, namely a stream of light fine material which is directed by the pipe 10 to a conventional gold reclamation circuit, a stream of coarse and/or heavy material which goes via the holding bin 7 back into the grinding mill and a bleed stream which goes via the bleed line 15 to the concentration circuit.

The bleed 15 contains the heavier particulates including large and/or flaky particles of gold which are difficult to recover by conventional gold recovery processes. This is because the concentration of reagents in conventional recovery processes, because of the very large volume of material which needs to be treated, has to be kept low and as a result, the larger gold particles tend to pass through a conventional gold leaching circuit without going into solution and are lost to waste.

The first concentrator 16 has a first concentrator overflow line 21 which recycles lighter material rejected by the concentrator to the holding bin 7 and hence grinding mill 2. A water line 18 controlled via taps 19 to both the first and second concentrator is used to maintain pressure in the two concentrators in the manner described in patent No. 684153. The concentrate from the first concentrator is directed via the first concentrate line 20 to the second concentrator 17 where the concentration process is repeated with the overflow from the second concentrator being returned to the overflow tank 28.

The concentrate from the second concentrator is directed via the second concentrate line 23 to the dewatering station where the major part of the liquid is separated from the solids. In order for the process to proceed efficiently, it is generally important to ensure that the amount of liquid mixed with solid entering the leach reactor is kept to a minimum. Thus it is anticipated that the dewatered "solid" exiting the dewatering station will be at least 55% and preferably at least 60% by weight of solids.

The dewatering station is run so that there are sufficient solids in the cylinder 84 to completely cover the outlet at the bottom of the conical base 85. This generally means that the solids will represent about 30% by volume of the solids/liquids mixture in the dewatering unit 32.

As the solids arc denser than the liquid contained therein, the proportion of solids can be sensed by a load cell 88 which simply measures the total weight of the assembly. When the weight exceeds a predetermined figure, the valve 89 may be opened preferably on a pulsating basis, until sufficient of the solids have been allowed to drain out as to return the overall weight of the assembly to within a prescribed range. Thus the dewatering station may be effectively operated continuously.

The dewatered solids are mixed with spent solution from the electrowin process fed by the electrowin recirculation line 85 and additional reagents in the form of caustic soda and sodium cyanide prior to being fed to the leach reactor via inlet 44. It is noted that because the electrowin process is run at ambient temperatures, the spent liquor recycled to the leach reactor will have large amounts of dissolved oxygen formed by the electrowin process. Additional air/oxygen may also be introduced into the reactor via a sparge line.

The residence time in the leach reactor will depend upon the particular qualities of the ore being treated. However it is to be appreciated that preg-robbing ores require as short a residence time as is reasonably practicable in order to minimise the amount of gold adsorbed by the preg-robbing carbon in the native ore body.

The leach reactor will typically be rotated at a peripheral speed of about 10 metres per minute. For a one metre diameter drum this involves a rotational speed of about 3 rotations per minute.

The baffles combined with the openings 104 and 105 in the leach reactor serve to limit the rate of progress of the leach mixture through the reactor in a controlled manner. Furthermore, the construction is such that the ratio of liquid reagent to solid material being leached can be adjusted to reflect the requirements for a particular solid. Thus, if the solid contains a high proportion of native carbon, the amount of reagent added by comparison to the volume of solid can be significantly increased and the residence time required for leaching can be correspondingly decreased. Where shorter residence times are required, it is a simple matter to increase the rate of reagent delivery and also the rate of rotation of the leach reactor to speed up the overall process. Thus the process is particularly suitable where ores of variable quality are being treated as it is possible to continuously monitor and adjust the rate of the leach reaction as is necessary.

Upon discharge from the leach reactor via the outlet 46, the leachant 47 is directed to a further dewatering station 50 which may be constructed in a similar manner to that described in relation to the first dewatering station 32.

The pregnant liquor 55 from the further dewatering station is directed to the flocculation tank 62 whereas the solids component 51 is directed to a further dewatering operation through the solids separation station 52.

The solids separation station includes a screen having a mesh size of about 100 microns which is inclined to the horizontal. The screen is driven to vibrate and cause the solids to ball up and "walk" uphill to be dropped off at the end into a receptacle and eventually returned via the solids recycling line 53 to the overflow tank 28. The pregnant liquor 54 separated by the screen as excess liquid, is also directed to the flocculation tank 62 where the liquid is mixed with flocculent delivered from the flocculent supply station 56 via the dosing pump 57 and flocculant delivery line 58.

The bottom of the flocculation tank is provided with an outlet for tapping solids which are recirculated via the solids recirculation pump 63 and solids recirculation line 64 to the dewatering station 50.

Similarly, pregnant liquor is taken from the upper part of the dewatering station via the pregnant liquor line 70 pumped via the pump 69 to a further settling storage tank 71.

This settling storage tank 71 is again used to control off take of pregnant liquor via the pregnant liquor line 81 and the pump 80 using the tap 82 to control supply to the electrowin station 83 which recovers gold from the pregnant liquor. Alternative gold recovery processes include the zinc precipitation or carbon based processes. Solids from the settling storage tank are directed to the overflow tank 28 via the line 73 after being mixed with liquid overflow from the tank 71 and excess liquid coming from the first dewatering station 32 via the excess liquid line 33.

A mixture of recycled solids and liquids from the overflow tank 28 is returned to the inlet of the first concentrator.

Similarly, the spent pregnant liquor solution is recycled to the leach reactor after going through the electrowin station.

The process and apparatus of the invention have particular advantages over the prior art in that they can be operated continuously, and they can cope with a range of different ore types with adjustments made to the rate of leaching and treatment in accordance with the properties of that ore type. In particular, because the volumes of concentrate treated are much smaller than the volume of feed initially introduced into the process, reagents may be economically used at high concentration. Furthermore, because of the high reagent concentrations, the rate of leaching is substantially increased with consequent decrease of leaching residence times and corresponding opportunity for native carbon to adsorb gold during leaching Thus, the invention is particularly suitable for treatment of preg-robbing ores. It also has major security advantages in that the gold in the circuit is not in a form which can be readily stolen, the only major security precautions required being in relation to the final electrowin process where solid gold is produced. However as this only represents a small part of the overall process it can be far more readily subjected to security conditions.

OPERATING RESULTS

The results below show the average daily recoveries of the in line leach reactor described with reference to the drawings operating at 80–100 kg/hr of gravity (<2 mm) concentrates. These recoveries are total recoveries and do not reflect free gold recoveries. No free gold was visible in the reactor solids tailing.

| Day | Feed (ppm) | Tail (ppm) | Recovery (%) |
|---|---|---|---|
| 1 | 819.00 | 13.00 | 98.41 |
| 2 | 381.00 | 10.50 | 97.24 |
| 3 | 686.00 | 3.25 | 99.53 |
| 4 | 1305.50 | 15.65 | 98.80 |
| 5 | 773.00 | 19.65 | 97.46 |
| 6 | 695.00 | 14.35 | 97.94 |

Whilst it has been convenient to describe the invention herein in relation to particularly preferred embodiments, it is to be appreciated that other constructions and arrangements are considered as falling within the scope of the invention. Various modifications, alterations, variations and/or additions to the constructions and arrangements described herein are also considered as falling within the scope and ambit of the present invention.

What is claimed is:

1. An apparatus for separating a valuable dense material from a slurry of variable quality, the apparatus composing:

a concentrator for therein concentrating the slurry to form a concentrate slurry containing the valuable dense material;

a leach reactor positioned downstream from said concentrator, said leach reactor comprising a rotatable hollow member, an inlet for charging the hollow member with the concentrate slurry and a leach reagent effective for dissolving the dense valuable material in the slurry to thereby form a leached slurry, an outlet for discharging the leached slurry from the hollow member, and a plurality of spaced apart baffles positioned as flow controllers within the hollow member defining a plurality of discrete zones therein, each baffle of the plurality having at least one opening therethrough to allow fluid communication between adjacent discrete zones, wherein the at least one opening in a baffle of the plurality is positioned toward a side of said hollow member and the at least one opening in a next baffle of the plurality is positioned toward a generally opposite side of said hollow member, and wherein said inlet said outlet and said at least one opening are disposed so that the leached slurry only feeds by gravity from the inlet through the at least one opening in baffles separating discrete zones to the outlet as said hollow member is axially rotated and the at least one openings and baffles are disposed so that a flow of slurry between adjacent discrete zones can only occur when the level of slurry in an upstream discrete zone is higher than that in an adjacent downstream discrete zone but is lower than the axis of rotation, and rotation of the hollow member brings said at least one opening in a baffle separating said adjacent discrete zones to a level below a point on the axis of rotation of the hollow member which lies in the same vertical plane as the at least one opening in said baffle separating said adjacent discrete zones;

a variable speed drive connected to rotate said hollow member at a rate predetermined according to slurry quality;

a pregnant liquor separator downstream from said outlet for separating the discharged leached slurry into solids and pregnant liquor containing the dissolved valuable dense material;

a recovery station downstream from said pregnant liquor separator for recovering the valuable dense material dissolved in the pregnant liquor thereby leaving a spent liquor; and a recycler for recycling spent leachate to said hollow member.

2. The apparatus of claim 1 wherein the concentrator comprises first and second in line pressure jigs in series, and further comprising:

a crusher connected to a supply of water and positioned upstream from the concentrator for crushing a feed and mixing the crushed feed with water to thereby form the slurry; and a primary separator positioned in a circuit between said crusher and said concentrator for separating coarse solids from the slurry and for returning the coarse solids to said crusher.

3. The apparatus of claim 1 further comprising a dewatering station positioned between the concentrator and the leach reactor for dewatering the concentrated slurry.

4. The apparatus of claim 2, wherein said primary separator further comprises at least one hydrocyclone for separating the slurry into at least a stream of coarse solids and a stream of fine solids.

5. The apparatus of claim 3, wherein the dewatering station comprises:

a container for therein receiving concentrate for dewatering, said container having a bottom generally shaped as a cone and including an outlet therein;

a weighing device for weighing concentrate received in said container; and a valve for metering an outflow of dewatered concentrate from the outlet.

6. The apparatus of claim 1, wherein said pregnant liquor separator further comprises:

a settling vessel for therein receiving the discharged leached slurry for setting of solids, said settling vessel having an outlet positioned adjacent a bottom of said vessel for draining settled solids therethrough;

a screen positioned to further separate the settled solids from liquid;

a settling storage tank for storing separated liquid; and a return for returning separated solids to said concentrator and separated liquid to said settling storage tank.

7. The apparatus for claim 6, wherein said settling storage tank further comprises a solids return for returning settled solids to said concentrator.

8. The apparatus of claim 7, further comprising a feeder for feeding stored pregnant liquor to said recovery station, and wherein said recovery station comprises an electrowinning station for recovery of the valuable dense material dissolved in the pregnant liquor and a spent liquor return for returning spent liquor from said electrowinning station to said settling storage tank.

9. The apparatus of claim 1, further comprising a sparger for sparging the concentrate in said leach reactor with an oxygen containing gas.

10. The apparatus of claim 1, wherein the valuable dense material comprises a precious metal.

11. The apparatus of claim 1, wherein the valuable dense material comprises gold.

12. A leach reactor for separating a valuable dense material from a slurry, said leach reactor comprising:

a hollow member having an axis and being rotatable thereabout;

an inlet generally in line with said axis for receiving the slurry into said hollow member;

an outlet for discharging leached slurry from said hollow member, said outlet generally in line with said axis and having a diameter sufficiently larger than said inlet to thereby generate a gravity flow of the slurry through the hollow member; and a plurality of baffles positioned to control slurry flow within the hollow member and defining a plurality of discrete zones therein, each individual baffle of the plurality of baffles having at least one opening therethrough to allow fluid communication between adjacent discrete zones, wherein the at least one opening is positioned along a first individual baffle adjacent a first side of said hollow member, and the at least one opening in a second baffle of the plurality is positioned along said second baffle adjacent a second side of said hollow member generally opposite said first side; wherein said inlet and said outlet are disposed relative to said hollow member so that slurry feeds by gravity from the inlet to the outlet as said hollow member is rotated.

* * * * *